US009157717B1

(12) United States Patent
Carroll et al.

(10) Patent No.: US 9,157,717 B1
(45) Date of Patent: Oct. 13, 2015

(54) PROJECTILE SYSTEM AND METHODS OF USE

(71) Applicant: The Boeing Company, Seal Beach, CA (US)

(72) Inventors: Galen Duff Carroll, Huntsville, AL (US); Eric M. Greuner, Austin, TX (US)

(73) Assignee: The Boeing Company, Chicago, IL (US)

( * ) Notice: Subject to any disclaimer, the term of this patent is extended or adjusted under 35 U.S.C. 154(b) by 186 days.

(21) Appl. No.: 13/746,964

(22) Filed: Jan. 22, 2013

(51) Int. Cl.

| | |
|---|---|
| ***F42B 15/01*** | (2006.01) |
| ***F41G 7/22*** | (2006.01) |
| ***F41H 13/00*** | (2006.01) |
| *F42B 15/00* | (2006.01) |

(52) U.S. Cl.
CPC ..... *F42B 15/01* (2013.01); *F41G 7/2206* (2013.01); *F41G 7/226* (2013.01); *F41G 7/2226* (2013.01); *F41G 7/2233* (2013.01); *F41H 13/00* (2013.01)

(58) Field of Classification Search
CPC ..... F41H 13/00; G05D 1/0088; G05D 1/02; G05D 1/021; G05D 1/0287; G05D 1/0291; G05D 1/0295; F42B 15/01; F41G 7/20; F41G 7/22; F41G 7/2206; F41G 7/2233; F41G 7/2246; F41G 7/226; F41G 7/2226
USPC ..... 89/1.11, 1.51, 1.54, 1.55, 1.8, 1.801, 89/1.802; 244/3.1–3.19, 3.2; 701/1, 3, 23, 701/24; 700/90, 245–249; 705/1
See application file for complete search history.

(56) References Cited

U.S. PATENT DOCUMENTS

| | | | | | |
|---|---|---|---|---|---|
| 3,048,087 | A | * | 8/1962 | Campbell | 89/1.802 |
| 3,169,727 | A | * | 2/1965 | Schroader et al. | 244/3.13 |
| 3,564,134 | A | * | 2/1971 | Rue et al. | 244/3.14 |
| 3,778,007 | A | * | 12/1973 | Kearney et al. | 244/3.14 |
| 4,267,562 | A | * | 5/1981 | Raimondi | 89/1.11 |
| 5,112,006 | A | * | 5/1992 | Palmer | 244/3.16 |
| 5,153,366 | A | * | 10/1992 | Lucas | 89/1.11 |
| 5,206,452 | A | * | 4/1993 | Stamper et al. | 89/1.11 |
| 5,471,213 | A | * | 11/1995 | Hergesheimer | 244/3.14 |
| 5,601,255 | A | * | 2/1997 | Romer et al. | 244/3.13 |
| 5,710,423 | A | * | 1/1998 | Biven et al. | 244/3.1 |
| 5,855,339 | A | * | 1/1999 | Mead et al. | 244/3.11 |
| 5,931,874 | A | * | 8/1999 | Ebert et al. | 701/3 |
| 5,983,771 | A | * | 11/1999 | Lehr | 89/1.55 |
| 5,992,288 | A | * | 11/1999 | Barnes | 89/1.11 |
| 6,037,899 | A | * | 3/2000 | Weber | 244/3.2 |
| 6,122,569 | A | * | 9/2000 | Ebert et al. | 701/3 |
| 6,122,572 | A | * | 9/2000 | Yavnai | 701/3 |
| 6,196,496 | B1 | * | 3/2001 | Moskovitz et al. | 244/3.15 |
| 6,349,898 | B1 | * | 2/2002 | Leonard et al. | 244/3.15 |
| 6,610,971 | B1 | | 8/2003 | Crabtree | |
| 6,615,116 | B2 | * | 9/2003 | Ebert et al. | 701/3 |

(Continued)

FOREIGN PATENT DOCUMENTS

GB 2148465 A * 5/1985

*Primary Examiner* — Bernarr Gregory
(74) *Attorney, Agent, or Firm* — Armstrong Teasdale LLP

(57) ABSTRACT

Systems, a ballistic device, and methods of use are provided herein. The system includes at least one first ballistic device having a first payload configured to detonate, and a second ballistic device configured to track at least one of a position and a movement of an object, and enable the at least one first ballistic device to identify at least one of the position and the movement of the object. The second ballistic device includes a second payload configured to detonate.

20 Claims, 3 Drawing Sheets

(56) References Cited

U.S. PATENT DOCUMENTS

| | | | | |
|---|---|---|---|---|
| 6,672,534 | B2 * | 1/2004 | Harding et al. | 244/3.15 |
| 6,832,740 | B1 | 12/2004 | Ransom | |
| 6,833,804 | B2 | 12/2004 | Atar | |
| 6,842,674 | B2 * | 1/2005 | Solomon | 701/23 |
| 7,047,861 | B2 * | 5/2006 | Solomon | 89/1.11 |
| 7,066,427 | B2 | 6/2006 | Chang | |
| 7,219,853 | B2 * | 5/2007 | Williams | 244/3.14 |
| 7,338,009 | B1 * | 3/2008 | Bobinchak et al. | 244/3.15 |
| 7,422,175 | B1 * | 9/2008 | Bobinchak et al. | 244/3.15 |
| 7,494,089 | B2 * | 2/2009 | Williams et al. | 244/3.16 |
| 7,494,090 | B2 * | 2/2009 | Leal et al. | 244/3.16 |
| 7,631,833 | B1 * | 12/2009 | Ghaleb et al. | 244/3.15 |
| 7,675,012 | B1 * | 3/2010 | Bobinchak et al. | 244/3.15 |
| 7,875,837 | B1 | 1/2011 | Szabo et al. | |
| 7,947,936 | B1 * | 5/2011 | Bobinchak et al. | 244/3.15 |
| 7,964,831 | B2 * | 6/2011 | Hurty | 244/3.11 |
| 8,084,724 | B1 * | 12/2011 | Brosch et al. | 244/3.16 |
| 8,084,726 | B2 * | 12/2011 | Hanlon et al. | 244/3.15 |
| 8,089,033 | B2 * | 1/2012 | Zank et al. | 244/3.1 |
| 8,119,958 | B2 | 2/2012 | Adams et al. | |
| 8,258,994 | B2 | 9/2012 | Hamilton | |
| 8,516,938 | B2 * | 8/2013 | Roemerman et al. | 89/1.54 |
| 8,710,411 | B1 * | 4/2014 | LaPat | 244/3.15 |
| 2004/0030448 | A1 * | 2/2004 | Solomon | 700/245 |
| 2004/0030449 | A1 * | 2/2004 | Solomon | 700/245 |
| 2004/0030570 | A1 * | 2/2004 | Solomon | 705/1 |
| 2004/0030571 | A1 * | 2/2004 | Solomon | 705/1 |
| 2004/0068351 | A1 * | 4/2004 | Solomon | 701/24 |
| 2004/0068415 | A1 * | 4/2004 | Solomon | 705/1 |
| 2004/0068416 | A1 * | 4/2004 | Solomon | 705/1 |

* cited by examiner

PROJECTILE SYSTEM AND METHODS OF USE

BACKGROUND

The present disclosure relates to swarm technology and, more particularly, to a projectile system and methods of use.

At least some known projectile systems include a plurality of projectiles (e.g., ballistic devices) that each includes at least one sensor, a boost package, and a payload. That is, in known ballistic defense projectile systems, each projectile has the same configuration such that one projectile includes every feature included in the other projectiles. Incorporating every feature into each projectile, however, is expensive and may be cost-prohibitive, particularly when the projectile includes a payload that is configured to detonate.

BRIEF SUMMARY

In one aspect, a method is provided. The method includes projecting a primary device including a sensor towards an object, tracking at least one of a position and a movement of the object using the sensor, generating target information associated with the tracked object to enable the object to be engaged by at least one secondary device.

In another aspect, a ballistic device is provided. The ballistic device includes a sensor configured to track an object, and an assignment module configured to generate target information associated with the object, and transmit the target information to at least one other ballistic device.

In yet another aspect, a system is provided. The system includes at least one first ballistic device, and a second ballistic device configured to track a position and/or movement of an object, and enable the at least one first ballistic device to identify the position and/or movement of the object.

The features, functions, and advantages described herein may be achieved independently in various implementations of the present disclosure or may be combined in yet other implementations, further details of which may be seen with reference to the following description and drawings.

Figure 1:
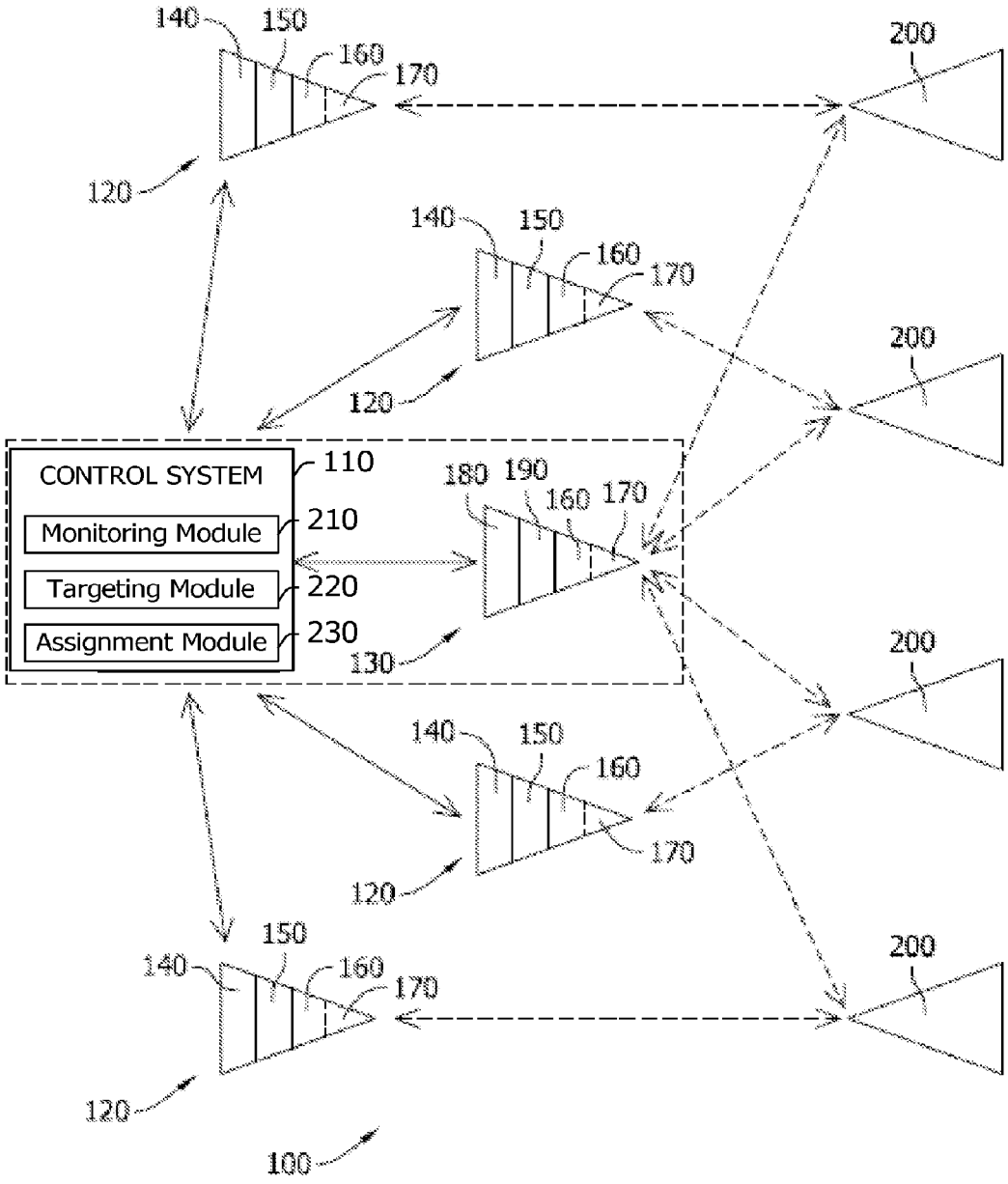
FIG. 1 is a schematic illustration of an exemplary ballistic defense system.

Although specific features of various implementations may be shown in some drawings and not in others, this is for convenience only. Any feature of any drawing may be referenced and/or claimed in combination with any feature of any other drawing.

DETAILED DESCRIPTION

The present disclosure relates to swarm technology and, more particularly, to a projectile system and method of use. Although the implementations described herein are described in a ballistic defense context, the implementations described herein may also be used for any application in any environment that enables the systems and methods to function and/or operate as described herein. For example, a vehicle (e.g. aircraft, ship, spacecraft, ground vehicle, or the like) and/or static structure (e.g. building, missile silo, or the like) could launch a plurality of projectiles (e.g. ballistic devices) to attack a plurality of targets wherein one of the plurality of projectiles (e.g. primary projectile) provides target information to the other projectiles (e.g. secondary projectiles). In another implementation, the vehicle and/or static structure could launch a primary projectile which comprises a plurality of secondary projectiles wherein the primary projectile provides target information to the secondary projectiles. Additionally, a primary projectile may be configured to engage a target if a secondary projectile does not make contact with the target In one implementation, at least one first ballistic device includes a receiver, and a second ballistic device includes a sensor and an assignment module. The second ballistic device detects an object, generates target information associated with the detected object, and transmits the target information to the at least one first ballistic device. Implementations of the methods and systems described herein enable a computing system to (i) track a position and/or a movement of an object; (ii) generate target information associated with the object; (iii) generate a target on the object; (iv) illuminate the object; (v) monitor a position and/or a movement of at least one secondary ballistic device; and (vi) transmit the target information to the at least one secondary ballistic device.

The methods and systems described herein may be implemented using computer programming or engineering techniques including computer software, firmware, hardware or any combination or subset thereof, wherein some of the technical effects may include: a) tracking a position and/or a movement of an object, b) generating target information associated with the object, c) generating a target on the object, d) illuminating the object, e) monitoring a position and/or a movement of at least one secondary ballistic device, and f) transmitting the target information to the at least one secondary ballistic device.

As used herein, an element or step recited in the singular and preceded with the word "a" or "an" should be understood as not excluding plural elements or steps unless such exclusion is explicitly recited. Moreover, references to "one implementation" or "some implementations" are not intended to be interpreted as excluding the existence of additional implementations that also incorporate the recited features.

FIG. 1 is a schematic illustration of an exemplary defense system 100 including a control system 110, at least one secondary device (e.g., a first ballistic device 120), and a primary device (e.g., a second ballistic device 130). Defense system 100 may include any number of ballistic devices 120 and/or 130 that enables defense system 100 to function as described herein. In some implementations, each first ballistic device 120 includes a transceiver and/or a receiver 140, a first sensor 150, and/or a boost package 160 configured to launch and/or project first ballistic device 120. In some implementations, each first ballistic device 120 includes a payload 170 configured to detonate. Alternatively, in one implementation, first ballistic device 120 is a "hit-to-kill" device that does not include payload 170. In some implementations, second ballistic device 130 includes a transceiver or transmitter 180, a second sensor 190, boost package 160 configured to launch and/or project second ballistic device 130. In at least some implementations, second ballistic device 130 includes a payload 170 configured to detonate. Alternatively, in one implementation, second ballistic device 130 is a "hit-to-kill" device that does not include payload 170.

In some implementations, the at least one first ballistic device 120 is coupled to second ballistic device 130 such that the at least one first ballistic device 120 is launched and/or projected with second ballistic device 130. In such implementations, the at least one first ballistic device 120 may be launched and/or projected from second ballistic device 130 while second ballistic device 130 is air borne or along a designated flight path. Alternatively, in other implementations, the at least one first ballistic device 120 may be launched and/or projected separately from second ballistic device 130.

In some implementations, second sensor 190 is configured to detect at least one object 200 and/or track a location or position of object 200. In at least some implementations, first sensor 150 has a first sensitivity, and second sensor 190 has a second sensitivity that is different than the first sensitivity, such that second sensor 190 is able to detect the at least one object 200 in at least one instance, when first sensor 150 is not able to detect the at least one object 200. For example, in one implementation, second sensor 190 is a higher-quality, relatively-sophisticated sensor, or is a combination of sensors, that is configured to detect a variety of different objects 200 in various environments, and first sensor 150 is a lower-quality, relatively-simple photodetector that is configured to detect light and/or electromagnetic energy. Remote sensing technology that may be used for sensors 150 and/or 190 include, without limitation, passive remote sensing technology such as photography, infrared, charged-coupled devices, and/or radiometers, and active remote sensing technology, such as light detection and ranging (LIDAR), radio detection and ranging (RADAR), and/or sound navigation and ranging (SONAR).

In some implementations, control system 110 is included in second ballistic device 130. Alternatively, in other implementations, control system 110 may be a distinct component that is remote from second ballistic device 130 (e.g., a ground station). In some implementations, control system 110 and/or second ballistic device 130 is programmed to determine a quantity of ballistic devices 120 and/or 130 included in defense system 100 for a particular mission. For example, in at least one implementation, control system 110 determines the quantity of ballistic devices 120 and/or 130 based at least partially on a number of objects 200 detected.

In some implementations, control system 110 and/or second ballistic device 130 includes a monitoring module 210 configured to determine positional data associated with the at least one first ballistic device 120, second ballistic device 130, and/or object 200. For example, in at least some implementations, control system 110 determines an absolute geographic location (e.g., GPS information) of the at least one first ballistic device 120, second ballistic device 130, and/or object 200. Additionally or alternatively, control system 110 determines a relative spatial location of the at least one first ballistic device 120, second ballistic device 130, and/or object 200 using, for example, triangulation or trilateration. Positional data, as used herein, may refer to an orientation and/or a position of any device.

In some implementations, monitoring module 210 monitors a relative and/or absolute position and/or a movement of the at least one first ballistic device 120, second ballistic device 130, and/or object 200. For example, in at least some implementations, monitoring module 210 is configured to generate a map of the at least one first ballistic device 120, second ballistic device 130, and/or object 200, and/or calculate a projected trajectory of the at least one first ballistic device 120, second ballistic device 130, and/or object 200 based on the positional data. Accordingly, in at least some implementations, monitoring module 210 facilitates providing command, control, management, and/or communications between ballistic devices 120 and 130.

In some implementations, control system 110 and/or second ballistic device 130 includes a targeting module 220 that is configured to generate a target on object 200, such that object 200 is detectable and/or identifiable by first sensor 150. For example, in one implementation, targeting module 220 is configured to illuminate object 200 with an ultraviolet, visible, or near infrared light, such that object 200 is detectable by a photodetector.

Additionally or alternatively, in some implementations, control system 110 and/or second ballistic device 130 includes an assignment module 230 configured to determine an operating configuration for the at least one first ballistic device 120, and transmit the operating configuration to the at least one first ballistic device 120. In at least some implementations, assignment module 230 may be configured to determine an operating configuration for second ballistic device 130.

For example, in at least some implementations, assignment module 230 determines that at least one first ballistic device 120 operates in the follow configuration when an object 200 is not assigned to the at least one first ballistic device 120. In the following configuration, the at least one first ballistic device 120 tracks and/or follows second ballistic device 130 and/or continues on a predetermined initial path.

In at least some implementations, assignment module 230 determines that the at least one first ballistic device 120 operates in the target configuration when object 200 is assigned to the at least one first ballistic device 120. In the target configuration, the at least one first ballistic device 120 is launched and/or projected towards object 200. More specifically, in at least some implementations, assignment module 230 is configured to generate target information associated with the detected object 200, and transmit the target information to the at least one first ballistic device 120. In such implementations, the at least one first ballistic device 120 is configured to receive the target information and be launched and/or projected toward object 200 using boost package 160 in accordance with the target information. In at least some implementations, the at least one first ballistic device 120 transmits a status and/or a location of the at least one first ballistic device 120 to control system 110 and/or second ballistic device 130.

Figure 2:
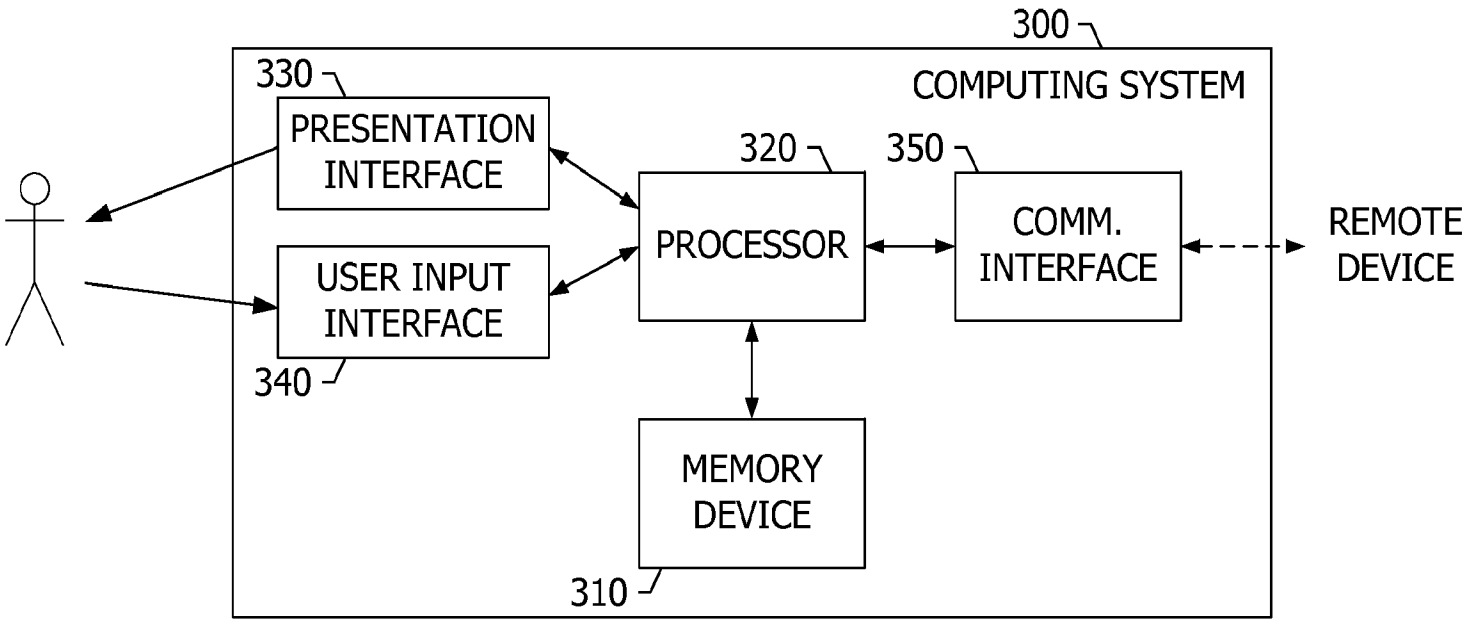
FIG. 2 is a schematic illustration of an exemplary computing system that may be used with the ballistic defense system shown in FIG. 1.

FIG. 2 is a schematic illustration of an exemplary computing system 300 that may be used with control system 110 and/or second ballistic device 130. For example, control system 110 and/or second ballistic device 130 may include computing system 300. In some implementations, computing system 300 includes a memory device 310 and a processor 320 coupled to memory device 310 for use in executing instructions. More specifically, in at least some implementations, computing system 300 is configurable to perform one or more operations described herein by programming memory device 310 and/or processor 320. For example, processor 320 may be programmed by encoding an operation as one or more executable instructions and by providing the executable instructions in memory device 310.

Processor 320 may include one or more processing units (e.g., in a multi-core configuration). As used herein, the term "processor" is not limited to integrated circuits referred to in the art as a computer, but rather broadly refers to a controller, a microcontroller, a microcomputer, a programmable logic controller (PLC), an application specific integrated circuit, and other programmable circuits.

In some implementations, memory device 310 includes one or more devices (not shown) that enable information such as executable instructions and/or other data to be selectively stored and retrieved. In some implementations, such data may include, but is not limited to, positional data, directional data, GPS data, map data, sensor data, operational data, and/or control algorithms. Alternatively, computing system 300 may be configured to use any algorithm and/or method that enable the methods and systems to function as described herein. Memory device 310 may also include one or more computer readable media, such as, without limitation, dynamic random access memory (DRAM), static random access memory (SRAM), a solid state disk, and/or a hard disk.

In some implementations, computing system 300 includes a presentation interface 330 that is coupled to processor 320 for use in presenting information to a user. For example, presentation interface 330 may include a display adapter (not shown) that may couple to a display device (not shown), such as, without limitation, a cathode ray tube (CRT), a liquid crystal display (LCD), a light-emitting diode (LED) display, an organic LED (OLED) display, an "electronic ink" display, and/or a printer. In at least some implementations, presentation interface 330 includes one or more display devices.

Computing system 300, in some implementations, includes an input interface 340 for receiving input from the user. For example, in at least some implementations, input interface 340 receives information suitable for use with the methods described herein. Input interface 340 is coupled to processor 320 and may include, for example, a joystick, a keyboard, a pointing device, a mouse, a stylus, a touch sensitive panel (e.g., a touch pad or a touch screen), and/or a position detector. It should be noted that a single component, for example, a touch screen, may function as both presentation interface 330 and as input interface 340.

In some implementations, computing system 300 includes a communication interface 350 that is coupled to processor 320. In some implementations, communication interface 350 communicates with control system 110, the at least one first ballistic device 120, and/or second ballistic device 130. For example, communication interface 350 may use, without limitation, a wired network adapter, a wireless network adapter, and/or a mobile telecommunications adapter. A network (not shown) used to couple computing system 300 to the remote device may include, without limitation, the Internet, a local area network (LAN), a wide area network (WAN), a wireless LAN (WLAN), a mesh network, and/or a virtual private network (VPN) or other suitable communication means.

Figure 3:
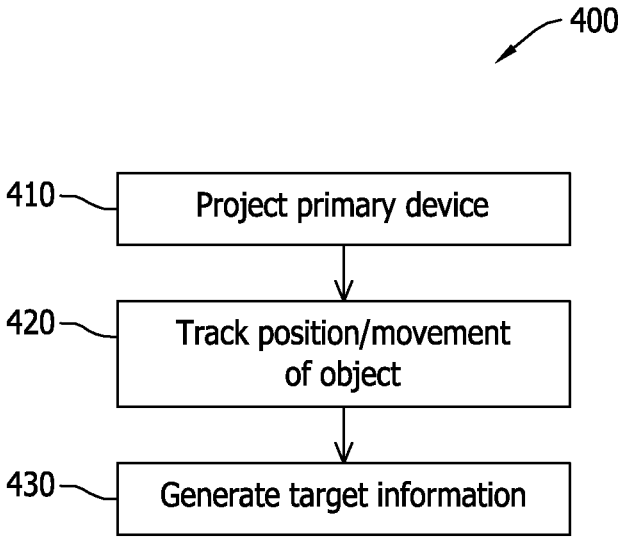
FIG. 3 is a flowchart of an exemplary method that may be implemented by the computing system shown in FIG. 2 to provide ballistic defense.

FIG. 3 is a flowchart of an exemplary method 400 that may be implemented to provide ballistic defense. During operation, in some implementations, object 200 is detected by defense system 100, and at least second ballistic device 130 is launched or projected 410 generally towards object 200. Additionally, in at least some implementations, at least one first ballistic device 120 is launched or projected generally towards object 200. In some implementations, at least one first ballistic device 120 is projected for each detected object 200.

In some implementations, object 200 is detected 420 by second sensor 190, which facilitates generating 430 targeting information. In at least some implementations, second sensor 190 detects 420 object 200 while second ballistic device 130 is in flight.

In some implementations, target information generated 430 at control system 110 and/or second ballistic device 130 enables the at least one first ballistic device 120 to detect object 200. For example, in at least one implementation, targeting module 220 illuminates object 200 with an ultraviolet, visible, or near infrared light, and the at least one first ballistic device 120 detects the light. In such an implementation, the at least one first ballistic device 120 is launched and/or projected towards the light. Additionally or alternatively, in at least some implementations, the target information is transmitted to the at least one first ballistic device 120, and the at least one first ballistic device 120 is launched and/or projected towards object 200 using boost package 160 in accordance with the target information.

In some implementations, payload 170 detonates upon contact with object 200 and/or in close proximity with object 200. Alternatively, in one implementation, first ballistic device 120 is a "hit-to-kill" system that does not include payload 170 and is configured to collide with object 200 with a high level of latent force (e.g., kinetic energy). That is, in such an implementation, object 200 is destroyed by the force of the collision.

The implementations described herein relate to ballistic defense systems. The implementations described herein enable ballistic defense systems to utilize swarm technology to coordinate communications and actions between ballistic devices. More specifically, the implementations described herein enable less-sophisticated (and, often, less expensive) ballistic devices to have a shorter expected life than that of more-sophisticated (and, often, more expensive) ballistic devices. Accordingly, the implementations described herein facilitate controlling a cost associated with maintaining an arsenal of ballistic devices. For example, the implementations described herein may be used to work against salvos and/or multiple warheads using intelligent designator/illuminator systems that are configured to guide a swarm of low-cost effectors towards the salvos and/or multiple warheads.

Some implementations of methods and systems for ballistic defense systems are described above in detail. The methods and systems are not limited to the specific implementations described herein, but rather, components of systems and/or steps of the method may be utilized independently and separately from other components and/or steps described herein. Each method step and each component may also be used in combination with other method steps and/or components. Although specific features of various implementations may be shown in some drawings and not in others, this is for convenience only. Any feature of a drawing may be referenced and/or claimed in combination with any feature of any other drawing.

This written description uses examples to disclose the various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising:

launching a primary ballistic missile towards an object, the primary ballistic missile including a sensor and a first payload configured to detonate;

tracking at least one of a position and a movement of the object using the sensor; and generating, by the primary ballistic missile, target information associated with the object to enable the object to be engaged by at least one secondary ballistic missile that includes a second payload configured to detonate.

2. A method in accordance with claim 1 further comprising transmitting the target information to the at least one secondary ballistic missile.

3. A method in accordance with claim 1, wherein the primary ballistic missile includes a targeting module, the method further comprising using the targeting module to generate a detectable target on the object such that the object is identifiable by the at least one secondary ballistic missile.

4. A method in accordance with claim 1, wherein the primary ballistic missile includes a targeting module, the method further comprising using the targeting module to illuminate the object.

5. A method in accordance with claim 1, wherein the primary ballistic missile includes a monitoring module, the method further comprising using the monitoring module to monitor at least one of a position and a movement of the at least one secondary ballistic missile.

6. A method in accordance with claim 1 further comprising launching the secondary ballistic missile towards the object.

7. A method in accordance with claim 6 further comprising launching the primary ballistic missile towards the object when the secondary ballistic missile does not make contact with the object.

8. The method in accordance with claim 1 wherein the target information is generated at the primary ballistic missile.

9. The method in accordance with claim 1 wherein the target information is generated at a ground station and transmitted to at least one of the primary ballistic missile and the secondary ballistic missile.

10. A ballistic missile comprising:

a first payload configured to detonate;

a sensor configured to track at least one of a position and a movement of an object; and an assignment module configured to generate target information associated with the object, and to transmit the target information to at least one other ballistic missile that includes a second payload configured to detonate.

11. A ballistic missile in accordance with claim 10 further comprising a targeting module configured to generate a detectable target on the object such that the object is identifiable by the at least one other ballistic missile.

12. A ballistic missile in accordance with claim 10 further comprising a targeting module configured to illuminate the object.

13. A ballistic missile in accordance with claim 10 further comprising a monitoring module configured to monitor at least one of a position and a movement of the at least one other ballistic missile.

14. A system comprising:

at least one first ballistic missile having a first payload configured to detonate; and a second ballistic missile configured to track at least one of a position and a movement of an object, and enable the at least one first ballistic missile to identify at least one of the position and the movement of the object, the second ballistic missile including a second payload configured to detonate.

15. A system in accordance with claim 14, wherein the second ballistic missile comprises a sensor configured to track at least one of the position and the movement of the object.

16. A system in accordance with claim 14, wherein the at least one first ballistic missile comprises a receiver, and the second ballistic missile comprises an assignment module configured to generate target information associated with the object, and transmit the target information to the receiver of the at least one first ballistic missile.

17. A system in accordance with claim 14, wherein the at least one first ballistic missile comprises a sensor configured to track at least one of the position and the movement of the object, and the second ballistic missile comprises a targeting module configured to generate a detectable target on the object that is identifiable by the sensor of the at least one first ballistic missile.

18. A system in accordance with claim 17, wherein the targeting module is configured to illuminate the object.

19. A system in accordance with claim 14, wherein the at least one first ballistic missile comprises a first sensor having a first sensitivity, and the second ballistic missile comprises a second sensor having a second sensitivity that is higher than the first sensitivity.

20. A system in accordance with claim 14, wherein the second ballistic missile comprises a monitoring module configured to monitor at least one of a position and a movement of the at least one first ballistic missile.

* * * * *